US005237918A

United States Patent [19]

Kobayashi et al.

[11] Patent Number: 5,237,918

[45] Date of Patent: Aug. 24, 1993

[54] PRINTING HEAD IN A DOT-LINE PRINTER

[75] Inventors: Hirotaka Kobayashi; Toshio Hiki; Yoshikane Matsumoto; Koichi Yageta, all of Katsuta, Japan

[73] Assignee: Hitachi Koki Co., Ltd., Tokyo, Japan

[21] Appl. No.: 855,482

[22] Filed: Mar. 23, 1992

Related U.S. Application Data

[63] Continuation of Ser. No. 515,357, Apr. 30, 1990, abandoned, which is a continuation of Ser. No. 190,350, May 5, 1988, abandoned, which is a continuation-in-part of Ser. No. 124,121, Nov. 23, 1987, Pat. No. 4,889,052.

[30] Foreign Application Priority Data

May 9, 1987 [JP] Japan ..... 62-69183[U]
Aug. 28, 1987 [JP] Japan ..... 62-216203

[51] Int. Cl.[5] ..... B41J 2/515

[52] U.S. Cl. ..... 101/93.04; 400/121

[58] Field of Search ..... 101/93.04, 93.05, 93.29, 101/93.34; 400/121, 124, 157.2, 157.3

[56] References Cited

U.S. PATENT DOCUMENTS

| | | | |
|---|---|---|---|
| 4,386,563 | 6/1983 | Farb | 101/93.04 |
| 4,387,642 | 6/1983 | Bringhurst et al. | 101/93.04 |
| 4,503,768 | 3/1985 | Whitaker | 101/93.04 |
| 4,550,659 | 11/1985 | Yamanaga | 101/93.04 |
| 4,599,007 | 7/1986 | Khorsand | 101/93.04 |
| 4,704,041 | 11/1987 | Hayashi et al. | 101/93.05 |
| 4,777,875 | 10/1988 | Fujiwara et al. | 101/93.04 |
| 4,879,947 | 11/1989 | Kurosawa et al. | 101/93.04 |
| 4,882,987 | 11/1989 | Sakai et al. | 101/93.04 |

FOREIGN PATENT DOCUMENTS

| | | | |
|---|---|---|---|
| 2224716 | 12/1972 | Fed. Rep. of Germany . | |
| 2525463 | 1/1976 | Fed. Rep. of Germany . | |
| 27266 | 2/1980 | Japan | 101/93.04 |
| 61486 | 5/1980 | Japan | 101/93.04 |
| 27376 | 3/1981 | Japan | 101/93.04 |
| 120356 | 9/1981 | Japan | 101/93.05 |
| 109671 | 7/1982 | Japan . | |
| 110463 | 7/1982 | Japan | 101/93.04 |
| 14768 | 1/1983 | Japan | 101/93.04 |
| 15170 | 1/1985 | Japan . | |
| 183164 | 9/1985 | Japan . | |
| 264259 | 12/1985 | Japan | 101/93.04 |
| 202855 | 9/1986 | Japan | 101/93.05 |

OTHER PUBLICATIONS

E. G. Lean et al.; "Print Hammer Mounting Arrangement for a Matrix Printer"; *IBM Tech Disc Bull.;* vol. 27, No. 2, pp. 1099-1100; Jul. 1984.

E. M. Baily et al; "Optimizing the Performance of an Electromechanical Print Mechanism"; *Hewlett Packard Journal;* Nov. 1978; pp. 23-31.

IBM Technical Disclosure Bulletin vol. 27, No. 2, Jul. 1984, pp. 1099-1100, "Print Hammer Mounting Arrangement"; Lean et al.

*Primary Examiner*—David A. Wiecking

*Attorney, Agent, or Firm*—Sixbey, Friedman, Leedom & Ferguson

[57] ABSTRACT

In a dot-line printer, a hammer bank carrying a plurality of dot printing hammers reciprocally moved along a printingline. Each of the printing hammers is made up of a leaf spring, one end of which is fixedly secured to the hammer bank and to another end of which a printing pin is attached. According to the invention, the plurality of dot printing hammers are separated into an odd-number group and an even-number group, in which the printing hammers in each of the odd-number and even-number groups are further separated into a predetermined number of sub-groups. The printing hammers in the odd-number group are arranged in the upper side of the printing line so that the printing pins extend downwardly and the printing hammers in the even-number group are arranged in the lower side of the printing line so that the printing pins extend upwardly. The printing pins in each of the sub groups of the odd-number group are positioned along a straight line inclined by a predetermined angle with respect to the printing line and the printing pins of the printing hammers in each of the sub groups of the even-number group are positioned along another straight line parallel to the aforementioned straight line. In order to facilitate fabrication of the printing hammers, the printing hammers in each of the sub groups are formed integrally to be in a comb-like shape.

8 Claims, 6 Drawing Sheets

PRINTING HEAD IN A DOT-LINE PRINTER

This application is a continuation of Ser. No. 07/515,357, filed Apr. 30, 1990, now abandoned, which was a continuation of Ser. No. 07/190,350, filed May 5, 1988, abandoned, which is a continuation-in-part application of application Ser. No. 124,121, filed Nov. 23, 1987, now U.S. Pat. No. 4,889,052.

BACKGROUND OF THE INVENTION

The present invention relates generally to a dot-line printer, and more particularly to a printing head for use in such a printer. In the dot-line printer, a hammer bank is reciprocally moved along a printing line to thereby carry out the printing of characters, symbols, etc. The hammer bank includes a plurality of dot-printing hammers separately provided at equal pitches along the printing line.

FIG. 1 shows one example of an arrangement of the printing hammers, in which each of the hammers is made up of a leaf spring 2 and a printing pin 1 attached to the upper end of the leaf spring. The lower end of each of the printing hammers is fixedly secured to a fixing member 3 by means of, for example, a screw (not shown). The printing hammers thus assembled are accommodated in the hammer bank and are reciprocated in forward and backward directions. The single forward or backward movement of the hammer bank is called "shuttle movement".

FIG. 2 shows a cross-sectional side view showing a printing hammer driving device. The leaf spring 2 is attracted to a pole of a yoke 5 by a permanent magnet 4, and when a release coil 6 is energized, the leaf spring 2 is released and the printing pin 1 strikes a paper through an ink ribbon (not shown). Since the printing pins 1 are juxtaposed along the printing line, printing of one dot-line is achieved by one shuttle movement of the hammer bank. If one character is formed with 24×24 dot matrix, it is necessary for the hammer bank to perform twenty-four shuttle movements. Therefore, there has been a limitation in increasing the printing speed.

In order to increase the printing speed, it has been proposed in the copending U.S. patent application Ser. No. 124,121 filed Nov. 23, 1987 to displace the position of the adjacent printing pins in the paper feeding direction by, for example, one dot-line. With N-number printing pins thus displaced, N dot-lines can simultaneously be printed. One example of such a hammer arrangement is illustrated in FIG. 3, with which 6 dot-lines are simultaneously printed with one shuttle movement of the hammer bank. According to such an arrangement of the hammers, printing of one line can be carried out with four (4) shuttle movements of the hammer bank.

While the arrangement of the printing hammers in FIG. 3 is advantageous in that the printing speed is increased, it is disadvantageous in that the leaf springs 2 have variations not only in spring constants but also in repeatability and operational characteristics of the striking forces. This is due to the fact that the distance from the fixing member 3 to the printing pin 1 is unequal in the respective print hammers. There exists five (5) dot-lines difference between the printing hammer in which the printing pin 1 is attached to the furthest position from the fixing member 3 and a print hammer in which the printing pin is attached to the nearest position from the fixing member 3. When the printing is carried out with the print hammers as in FIG. 3, the printing speed is restricted by the printing hammer of the worst repeatability. For this reason, a limitation still exists in increasing the printing speed.

In view of the disadvantages accompanying in such prior art print hammers, it has been proposed as illustrated in FIG. 4 to attach a plurality of print hammer modules to a module attachment member 8 through a holder 7. Each hammer module contains a predetermined number of printing hammers (four in FIG. 4). The printing hammers are mounted in inclined manner with respect to the attachment member 8. In the hammer module, the distance between the fixing member 3 and the printing pin 1 of each of the printing hammers is made substantially equal to one another. According to the arrangement shown in FIG. 4, while the operational characteristics of the respective printing hammers can substantially be made equal to one another, another disadvantages are introduced such that the structure is complicated and the cost of the dot-line printer becomes expensive due to the increase of the number of the components.

Further, it has been known in the art that for the purpose of preventing a magnetic interference and suppressing vibrations of a mechanical frames, every other printing hammers are mounted so as to be displaced by an amount corresponding to one-half of a dot printing pitch (hereinafter referred to as "a half-dot") in the direction perpendicular to the paper feeding direction. Referring to FIG. 6, the printing pins are to be mounted at equal pitches P, but every other printing pins are displaced by the amount of the half-dot in the left direction. The displaced printing pins are indicated with black circles and the normally placed printing pins are indicated with white circles. In the printing pins thus arranged, all the printing hammers are not simultaneously fired, so that the magnetic interference can be prevented and the impact occuring at the time of striking the printing pins against the paper is decreased, whereby the mechanical vibrations are suppressed.

In the printing hammer shown in FIG. 5, since it is necessary that every other printing hammers be displaced by the amount of the half dot, fabrication of the printing hammers in such a fashion is troublesome and thus the final product becomes costly.

SUMMARY OF THE INVENTION

In view of the foregoing, it is an object of the present invention to eliminate the drawbacks accompanying in the prior art printing heads and to provide an improved printing head in which the printing can be carried out at a higher speed.

It is another object of the invention to provide a printing head in which the operational characteristics of dot print hammers can be made substantially equal.

It is still another object of the invention to provide a printing head in which manufacture and fabrication of the printing hammers are facilitated.

Yet another object of the invention is to provide a printing head in which the operational characteristics of each of the printing hammers are made to be substantially equal.

In order to achieve these and other object, the present invention provides a dot-line printer of the type in which a hammer bank carrying a plurality of dot printing hammers juxtaposed along a printing line reciprocates with forward and backward directions along the printing line and printing is carried out as the hammer bank reciprocates and a printing paper is fed over predetermined dot-lines in a direction perpendicular to the printing line. According to the invention, the plurality of dot printing hammers are separated into a first group and a second group, printing hammers in each of the first and the second groups are further separated into a predetermined number of sub-groups. The printing hammers in the first group are fixedly secured to the hammer bank so that the second end of each of the printing hammers in the first group extend downwardly toward the printing line, and printing hammers in the second group are fixedly secured to the hammer bank so that the second end of each of the printing hammers in the second group extend upwardly toward the printing line. The printing hammers in the first group and the printing hammers in the second group being alternately juxtaposed along the printing line, and wherein the printing pins of the printing hammers in each of the sub groups of the first group are positioned along a first line being inclined by a predetermined angle with respect to the printing line and the printing pins of the printing hammers in each of the sub groups of the second group are positioned along a second line parallel to the first line.

In order to prevent the magnetic interference and suppress vibrations of mechanical frame, every other printing hammers in the first group are arranged at equal intervals along the printing line and the printing hammer interposing between adjacent two printing hammers of the every other printing hammers is displaced by a predetermined distance from a center of the adjacent two printing hammers, so that adjacent two printing hammers in the first and second groups are not simultaneously fired.

Further, in order to facilitate fabrication of the printing hammers, the printing hammers in the sub groups of the first and second groups are integrally formed in comb-like shape.

In order to attain the same operational characteristic for all the printing hammers, the printing hammer is made to be substantially in a trapezoidal shape in which the printing pin is attached to an upper side portion and a lower side portion is secured to the hammer bank. The lower side width of the printing hammer is changed depending upon a height of the printing hammer to have the same operational characteristic.

DETAILED DESCRIPTION OF THE PREFERRED EMBODIMENTS

A first embodiment of the present invention will be described with reference to FIGS. 7A through 7C in which the printing hammers are consecutively numbered from the left side. The printing hammers are divided in two groups, one being located in the upper side of the printing line and the other being located in the lower side thereof. One ends of the odd-numbered printing hammers are fixedly secured to an upper fixing member 13 and are downwardly extending substantially perpendicular to a printing line. On the other hand, even-numbered printing hammers are fixedly secured to a lower fixing member 23 and upwardly extending substantially perpendicular to the printing line. Both the upper and lower fixing member 13 and 23 are coupled to clamping members 19 arranged in right and left sides of the printing hammers and are extending substantially parallel to the printing hammers.

Figure 1:
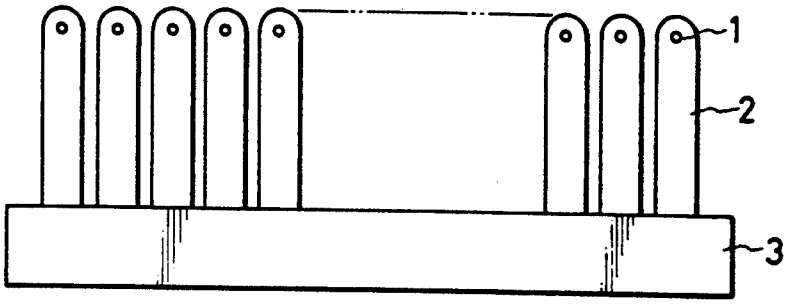
FIG. 1 (PRIOR ART)
FIG. 1 is a front schematic view showing one example of a prior art printing head.
Figure 2:
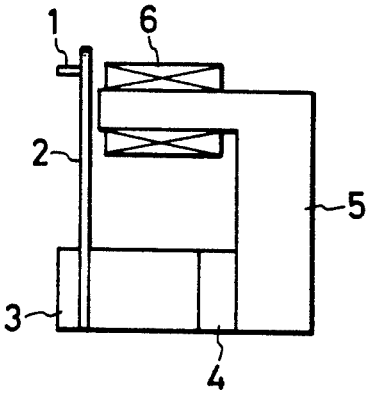
FIG. 2 (PRIOR ART)
FIG. 2 is a cross-sectional view showing a printing hammer driving device.
Figure 3:
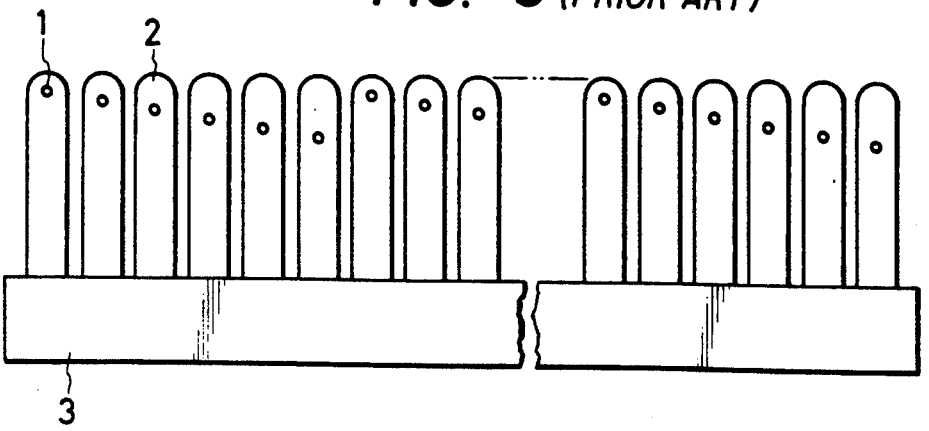
FIG. 3 (PRIOR ART)
FIG. 3 is a front schematic view showing another example of a prior art printing head.
Figure 4:
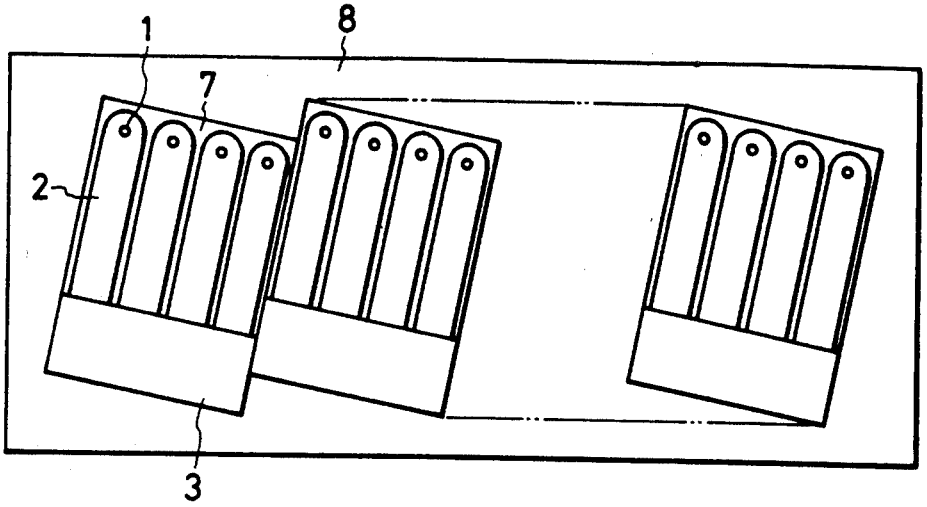
FIG. 4 (PRIOR ART)
FIG. 4 is a front schematic view showing still another example of a prior art printing head.
Figure 5:
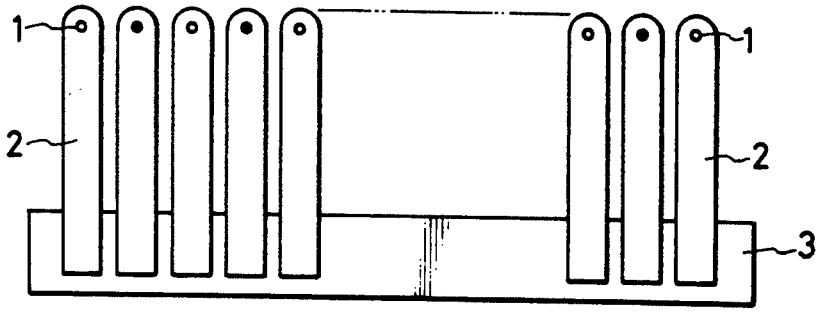
FIG. 5 (PRIOR ART)
FIG. 5 is a front schematic view showing one example of a prior art printing hammer assembly.
Figure 6:
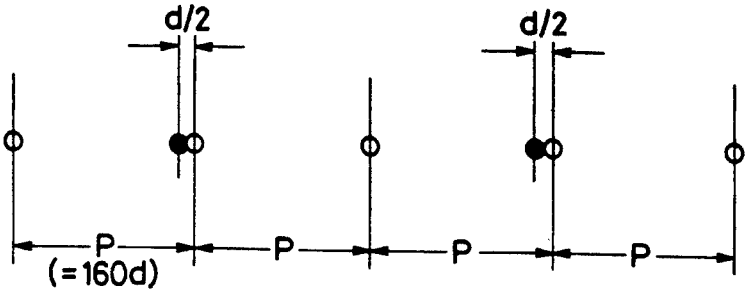
FIG. 6 is an explanatory diagram for explaining printing pin attachment positions.

Each of the two groups of the printing hammers is further divided into a predetermined number of sub groups. A first sub group of the printing hammers includes first to sixth printing hammers. A second sub group of the printing hammers includes seventh and twelveth printing hammers and is arranged adjacent the first sub group of the printing hammers. In this manner, a plurality of sub groups of the printing hammers are arranged along the printing line. The upper three printing hammers in the first sub group are secured to the upper fixing member 13 in such a manner that the printing pin 11 is displaced by one dot-line in the direction perpendicular to the printing line with respect to the position of the left adjacent printing pin and the three printing pins are positioned on a straight line inclined by a predetermined angle with respect to the direction of the printing line. The respective printing pins in the lower three printing hammers in the first sub group are also displaced in such a manner that the printing pin 21 is displaced by one dot-line in the direction perpendicular to the printing line with respect to the position of the left adjacent printing pin and the three printing pins are positioned on a line inclined by the predetermined angle with respect to the direction of the printing line. That is, the printing hammers in the first sub group are arranged so that with one shuttle movement of the hammer bank, six dot-lines are simultaneously printable. More specifically, the first printing hammer prints the first dot-line, the third printing hammer prints the second dot-line, the fifth printing hammer prints the third dot-line, the second printing hammer prints the fourth dot-line, the fourth printing hammer prints the fifth dot-line, and the sixth printing hammer prints the sixth dot-line. In this manner, the upper three printing hammers in the first sub group are displaced by three (3) dot-lines at maximum in the direction perpendicular to the printing line. The same is true with respect to the lower three printing hammers in the first sub group. The amount of displacement is therefore reduced to 1/2.5 with respect to the arrangement shown in FIG. 3. As a result, the variations in the operational characteristics of each of the printing hammers can be reduced, so that the printing can be carried at a higher speed. While the printing speed is restricted by the printing hammer of the worst repeatability as in the case of the printing head shown in FIG. 3, the printing speed can be increased due to the small variations in the repeatability. Further, due to the simplified arrangement, an inexpensive printer can be provided.

Figure 7A:
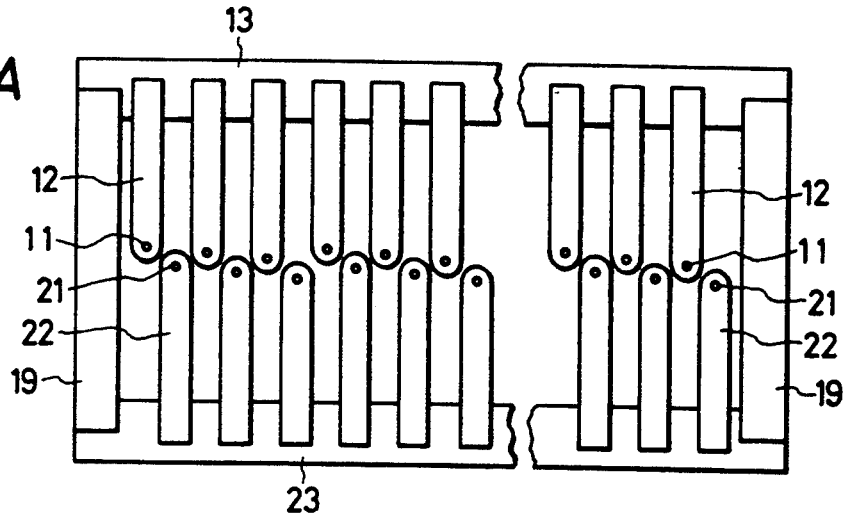
FIGS. 7A, 7B and 7C are front schematic views showing a first embodiment of the present invention.
Figure 7B:
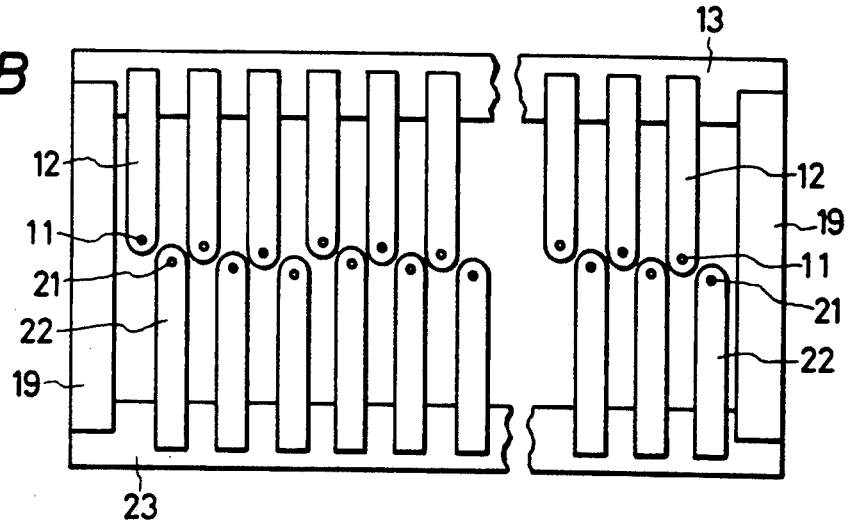

FIG. 7B is a modification of the printing head shown in FIG. 7A, in which like reference numerals in FIG. 7A designate like components in FIG. 7B. The printing hammers in FIG. 7B are identically arranged to those in FIG. 7A except that the printing hammers marked with black circles in the positions of the printing pins are displaced by the amount of the half dot in the leftward direction. That is, the printing hammers are arranged so that the adjacent printing hammers in each of the upper and lower sides are not simultaneously fired.

According to the printing head shown in FIG. 7B, it is possible to carry out printing every six dot-lines at the same time with one shuttle movement of the hammer bank, so that the high speed printing is ensured. Furthermore, the magnetic interference caused by the simultaneous firing of the adjacent two printing hammers is prevented and the vibration of the mechanical frames are suppressed.

Figure 7C:
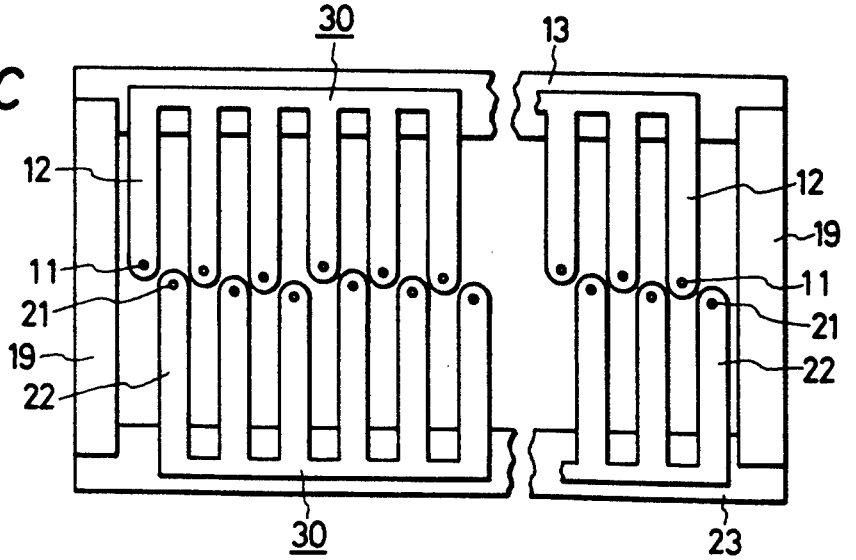

FIG. 7C is another modification of the printing head in which like reference numerals in FIG. 7A or 7B designate like components in FIG. 7C. The printing hammers in FIG. 7C are identically arranged to those in FIG. 7B. The modification shown in FIG. 7C is different from that shown in FIG. 7B in that the six printing hammers are integrally formed in comb-like shape to provide a hammer module 30 and a plurality of such modules are arranged in the upper and lower sides along the printing line.

More specifically, six leaf springs 22 to which the second, fourth, sixth, eighth and twelveth printing pins are attached are formed from a single plate so that each of six leaf springs separately extend upwardly from the common base portion. In the hammer module 30, the printing pins marked with the black circles which are displaced by the amount of the half dot from the equi-pitched position may be formed either by forming the leaf springs in equi-pitch and attaching the printing pin to be displaced by the amount of the half dot from the center in the top portion of the leaf spring or by forming every other leaf springs so as to displace by the amount of the half dot from the equi-pitched position and attaching the print pin at the center in the top portion of the leaf springs.

In the embodiment shown in FIG. 7C, the hammer module is made up of six hammers. However, the number of the printing hammers in the module is not limited to six, but any suitable number of the printing hammers may be included therein.

With the arrangement that all the printing hammers are juxtaposed along the printing line, when it is intended to print N dot-lines simultaneously by one shuttle movement of the hammer bank, the hammer module may be formed with (N×M) printing hammers, where N is an integer more than two (2) and M is an integer. When it is intended to simultaneously print six dot-lines by the one shuttle movement of the hammer bank, the formation of the hammer module with three hammers is not advantageous in terms of formation of the hammer module and the fabrication thereof, since two different kinds of the hammer modules need to be provided. Therefore, when N is an odd-number, it is preferred that the hammer module include the printing hammers of (N×2×M). On the other hand, when N is an even-number, the hammer module can include the printing hammers of (N×M). Further, with the arrangement in FIG. 7C in which a half of the printing hammers are arranged in upper portion and a second half of the printing hammers are arranged in lower portion, the hammer module including (N×2×M) is capable of printing 2N dot-lines simultaneously with one shuttle movement of the hammer bank.

According to the embodiment in FIG. 7C, it is advantageous in that not only the printing speed is increased but also the manufacture and fabrication of the printing head is facilitated.

Figure 8:
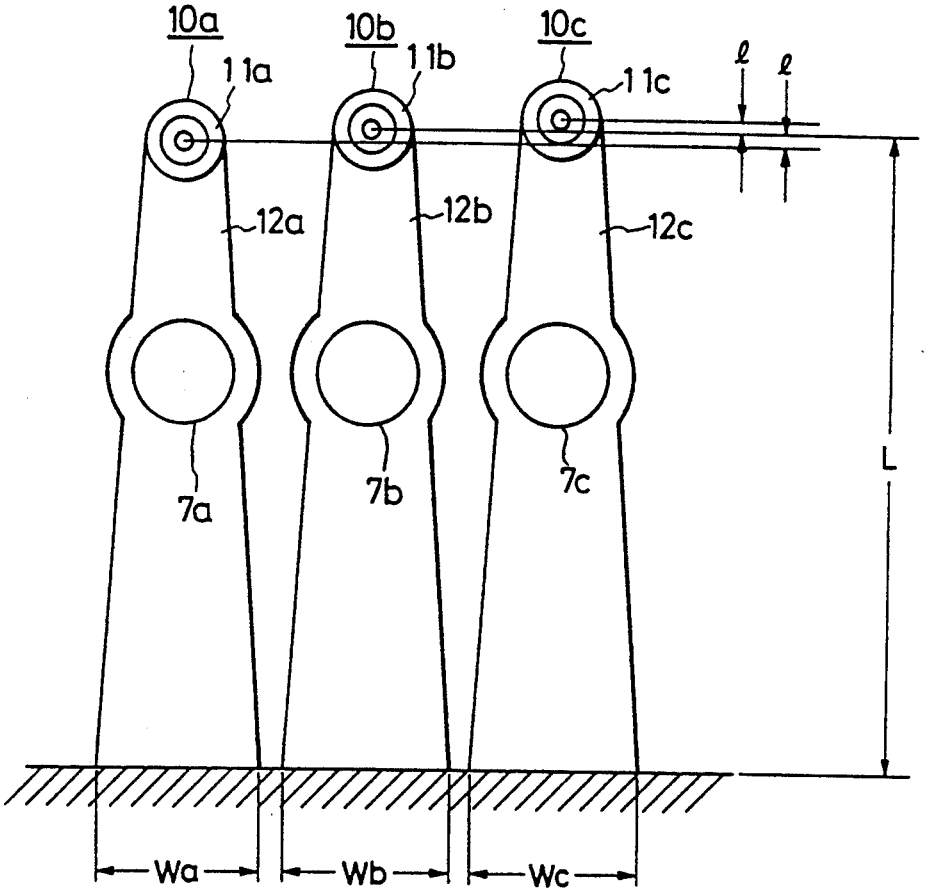
FIG. 8 is a front schematic view showing three consecutive printing hammers according to a second embodiment of the present invention.

Next, a second embodiment of the invention will be described with reference to FIGS. 8 and 9A through 9C. In FIG. 8, references 7a, 7b and 7c designate plungers attached to the center portions of the leaf springs 12a, 12b and 12c, respectively. FIG. 8 shows consecutively arranged three printing hammers in which the lengths or heights of the leaf springs 12a, 12b and 12c in the left hammer 10a, central hammer 10b and the right hammer 10c are (L−l), L, and (L+l), respectively, where l is the distance between the adjacent print pins and L is the length of the central leaf spring 12b. Assuming that equivalent masses of the printing hammers 10a, 10b and 10c are $m_a$, $m_b$ and $m_c$ and spring constants thereof are $k_a$, $k_b$ and $k_c$, respectively, there is a relationship of $m_a<m_b<m_c$. Specifically, as the length of the leaf spring increases, the equivalent mass thereof increases. In order to make natural frequencies of the respective printing hammers equal, it is necessary to meet the following relation:

$$k_a/m_a=k_b/m_b=k_c/m_c$$

That is, it is necessary to establish the following relation:

$$k_a<k_b<k_c$$

In other words, it is necessary that if the length of the leaf spring 12 is increased, the spring constant needs to be correspondingly increased. The spring constant is represented by the following equation.

$$k=(W\cdot t^3\cdot E)/(4\cdot\alpha\cdot L^3)$$

where W represents a width in the foot portion of the leaf spring; t, a thickness of the leaf spring; E, Young's modulus; and $\alpha$ represents a form factor determined according to the form or shape of the leaf spring. The form factor $\alpha$ can be expressed by the following equation.

$$\alpha=3/(1-\beta)\{3/2-1/(1-\beta)-[\beta/)]^2\log\beta\}$$

Assuming that the width at the tip end of the leaf spring is w, there is a relationship of $\beta=w/W$. Accordingly, the widths in the foot portions in the respective leaf springs need to meet the following relation:

$$W_a<W_b<W_c$$

As can be appreciated from the foregoing, the natural frequencies of the respective printing hammers can be made substantially equal to one another by maintaining the ratio of k/m at constant value. The width W in the foot portion of the leaf spring must be increased as the length of the leaf spring is increased.

Figure 9A:
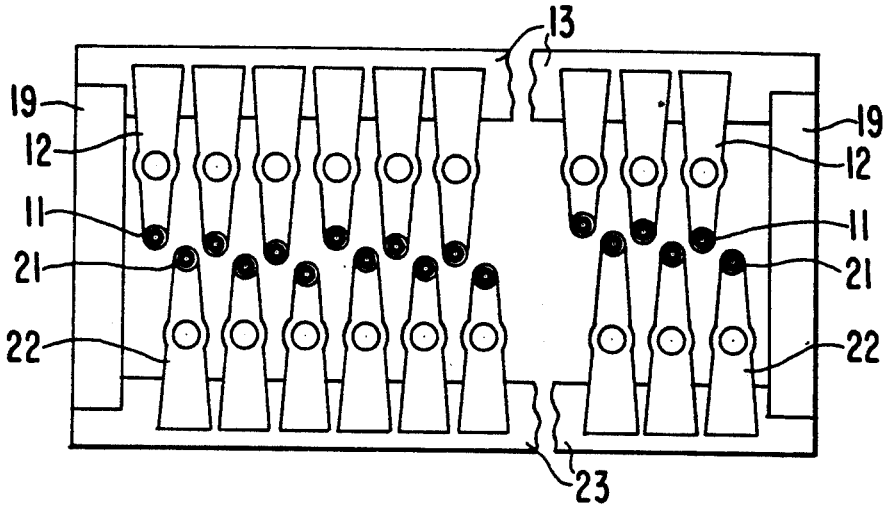
FIGS. 9A, 9B and 9C are front schematic views showing the second embodiment of the present invention.
Figure 9B:
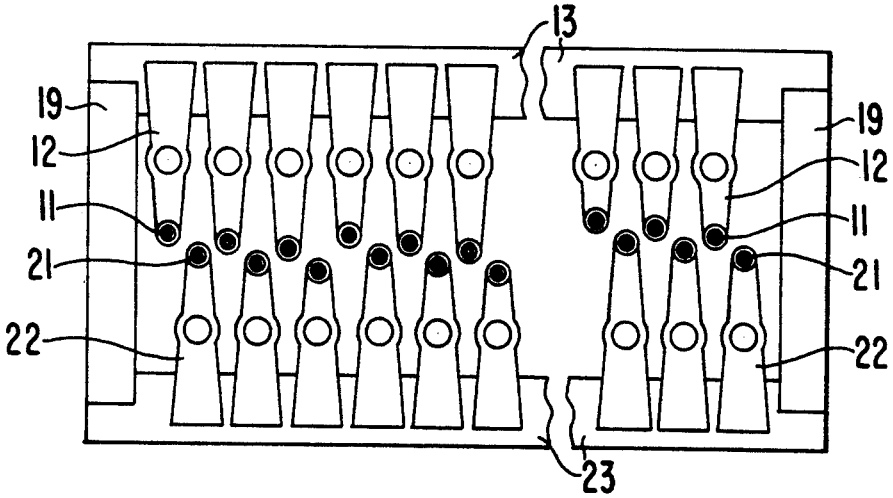
Figure 9C:
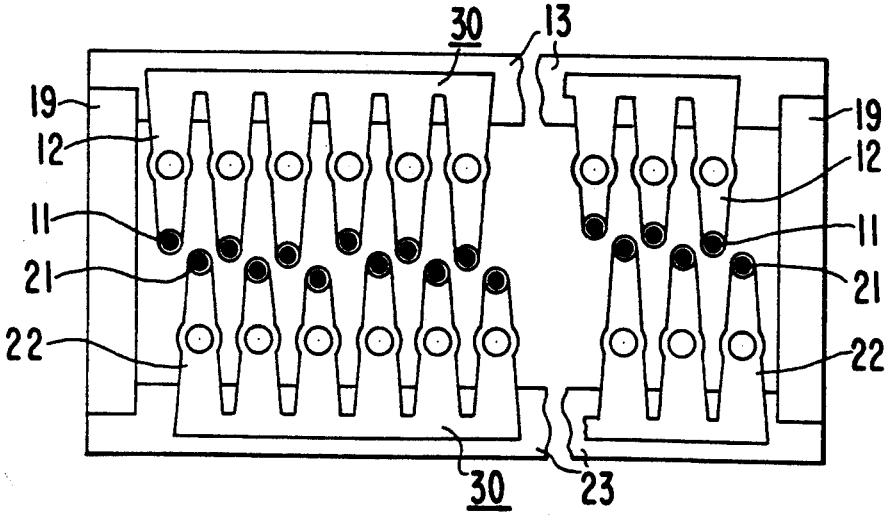

The printing heads arranged by employing the printing hammers in FIG. 8 are shown in FIGS. 9A through 9C which correspond to the embodiments shown in FIGS. 7A through 7C, respectively. Specifically, the printing hammers shown in FIG. 9A are arranged at equi-pitch along the printing line and the positions of the printing pins are displaced in the direction perpendicular to the printing line in the manner as described with reference to the embodiment shown in FIG. 7A. The printing heas shown in FIG. 9B is a modification of the printing head shown in FIG. 9A. The print hammers marked with black circles at the portions of the printing pins are arranged to be displaced by the amount of the half dot from the equi-pitched position so that the simultaneous firing of the adjacent two print hammers is prevented and the vibrations of the mechanical frames are suppressed. The printing head shown in FIG. 9C is a modification of the printing head shown in FIG. 9B. The consecutively arranged six printing hammers are made to be one unit to provide a hammer module 30 to facilitate the manufacture of the printing hammers and fabrication thereof, etc.

In the printer heads shown in FIGS. 9A through 9C, the width in the foot portion of the leaf spring is changed depending upon the length of the leaf spring, and the thickness of the leaf spring is not changed. The reason for this will be explained hereinbelow.

When forming the hammer module as shown in FIG. 9C, the respective printing hammers are pull out from a single sheet and the resultant printing module is finished by grinding it to be a predetermined thickness. If the thickness of the printing hammer is changed depending upon the length of the leaf spring, the leaf springs needs to be ground by using a stepped grinder or the like, thereby causing to degrade the working efficiency.

When each of the leaf springs is formed individually while changing the thickness of the leaf spring, a difficulty is encountered in that steps corresponding to the difference in thickness need to be formed in the fixing member and thus there is a difficulty in fabricating the printing hammers in the fixing member. It should be noted that the thickness of the leaf spring is in the range from several microns to the several tens microns. As described above, it is easier to change the length of the leaf spring rather than to change the thickness thereof. In order to change the width in the foot portion of the leaf spring, only the etching dye may be changed.

According to the second embodiment of the invention, the operational characteristics of the respective printing hammers can be made uniform, so that not only the printing speed is increased but also the printing quality is enhanced.

Figure 10:
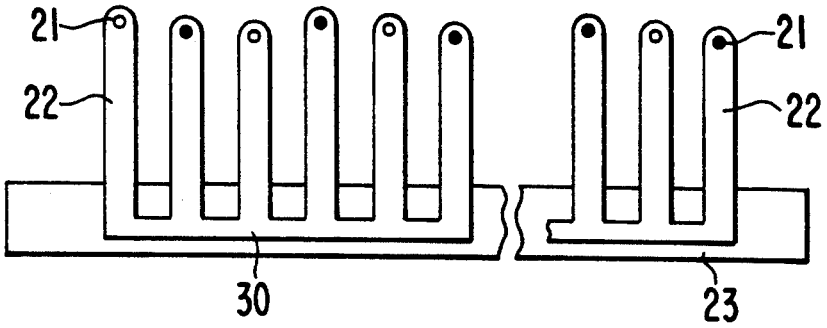
FIG. 10 shows a third embodiment of a hammerbank according to the present invention.

Although it has been described with reference to specific embodiments, it can be appreciated for a person skilled in the art that various changes and modifications may be made without departing from the scope and spirit of the invention. For example, in the first embodiment shown in FIGS. 7A through 7C and in the second embodiment shown in FIGS. 9A through 9C, the upper print hammers and the left and right sides clamping members may be removed and the printing may be carried out in such a manner that with a single shuttle movement of the hammer bank, three dot-lines are simultaneously printed as shown in FIG. 10. In addition, the number of the printing hammers contained in the hammer module is not limited to six as in the case of the embodiments shown in FIGS. 7C and 9C, but the hammer module may contain a number multiplying six (6) by an appropriate number of integer. When it is intended to simultaneously print four dot-lines in one shuttle movement of the hammer bank, the hammer module may be formed with either four (4), or eight (8), or twelve (12), and so on.

What is claimed is:

1. In a dot-line printer comprising a hammer bank carrying a plurality of dot printing hammers juxtaposed along a printing line, each of said plurality of dot printing hammers comprising a leaf spring having a first end fixedly secured to said hammer bank and a second end to which a printing pin is attached, said hammer bank reciprocating with forward and backward movement along said printing line to thereby carry out printing as said hammer bank reciprocates and as the printing paper is fed over predetermined dot-lines in a paper feeding direction perpendicular to said printing line, the improvement wherein said plurality of dot printing hammers are separated into a first group and a second group, the first and second groups including first and second halves of said plurality of printing hammers, respectively, the first half of said plurality of printing hammers, in said first group, being further divided into a predetermined number of sub groups and fixedly secured to an upper part of said hammer bank so that first ends of said printing hammers in said first group are secured to said hammer bank along a first line parallel to said printing line, and second ends of said printing hammers in said first group extend downwardly along said paper feeding direction; and the second half of said printing hammers, in said second group, being further divided into said predetermined number of sub groups and fixedly secured to a lower part of said hammer bank so that first ends of said printing hammers in said second group are secured to said hammer bank along a second line parallel to said printing line and second ends of said printing hammers in said second group extend upwardly along said paper feeding direction, wherein said printing hammers in said first group and said printing hammers in said second group are alternately juxtaposed along the printing line arranged one from the other and said printing pins of said printing hammers in each of said sub groups of said first group being substantially in-line on one of a first plurality of parallel straight lines inclined by a predetermined angle greater than zero with respect to said printing line where said first plurality of parallel straight lines respectively correspond to said sub groups of the first group and said printing pins of said printing hammers in each of said sub groups of said second group being substantially in-line on one of a second plurality of parallel straight lines parallel to said first straight lines where said second plurality of parallel straight lines respectively correspond to said sub groups of the second group.

2. A dot-line printer as claimed in claim 1, wherein said printing pins in each of said sub groups of said first and said second groups are displaced by one dot-line from one another.

3. A dot-line printer as claimed in claim 2, wherein neighboring two printing pins in each of said sub groups of said first and said second groups are displaced by one dot-line from each other.

4. A dot-line printer as claimed in claim 3, wherein alternate printing hammers in said first group are arranged at equal intervals along said printing line and the printing hammer interposed between each pair of said alternate hammers is displaced a predetermined distance greater than zero from a center of a distance between two adjacent printing pins.

5. In a dot-line printer comprising a hammer bank carrying a plurality of dot printing hammers juxtaposed along a printing line, each of said plurality of dot printing hammers comprising a leaf spring having a first end fixedly secured to said hammer bank and a second end to which a printing pin is attached, said hammer bank reciprocating with forward and backward movement along said printing line to thereby carry out printing as said hammer bank reciprocates and as the printing paper is fed over predetermined dot-lines in a paper feeding direction perpendicular to said printing line, the improvement wherein lengths of successive ones of said leaf springs increase so that the second ends of said printing hammers are displaced by predetermined distances from one another in a direction perpendicular to said printing line, and wherein each of said leaf springs is substantially trapezodial in shape and a width of a lower side of said trapezoidal shape depends upon the length of each said trapezoidal shape so that a natural frequency of each of said printing hammers is substantially equal to one another.

6. A dot-line printer comprising a hammer bank carrying a plurality of dot printing hammers juxtaposed along a printing line, each of said plurality of dot printing hammers comprising a leaf spring having a first end fixedly secured to said hammer bank and a second end to which a printing pin is attached, said hammer bank reciprocating with forward and backward movement along said printing line to thereby carry out printing of N dot-lines in each unidirectional shuttle movement, N being an even integer more than two, and the printing paper being fed over the N dot-lines in a paper feeding direction perpendicular to said printing lines between shuttle movements, wherein said printing pins of N dot printing hammers are displaced by one dot-line from one another in said paper feeding direction, and said N dot printing hammers are respectively disposed along imaginary parallel columns extending in said paper feeding direction, said printing hammers being divided into an odd-number group containing at least one printing hammer arranged in an odd-number column and an even-number group containing at least one printing pins of arranged in an even-number column, the printing pins of said printing hammers in said even-number group being displaced by predetermined distances greater than zero in the direction of the printing line, and wherein at least one set of said N printing hammers are integrally formed to be a module structure such that said first end of each of said printing hammers is commonly connected;

wherein said module structure includes $N \times M$ of said printing hammers, where M is an integer.

7. A dot-line printer comprising a hammer bank carrying a plurality of dot printing hammers juxtaposed along a printing line, each of said plurality of dot printing hammers comprising a leaf spring having a first end fixedly secured to said hammer bank and a second end to which a printing pin is attached, said hammer bank reciprocating with forward and backward movement along said printing line to thereby carry out printing of N dot-lines in each unidirectional shuttle movement, N being an odd integer more than two, and the printing paper being fed over the N dot-lines in a paper feeding direction perpendicular to said printing lines between shuttle movements, wherein said printing pins of N dot printing hammers are displaced by one dot-line from one another in said paper feeding direction, and said N dot printing hammers are respectively disposed along imaginary parallel columns extending in said paper feeding direction, said printing hammers being divided into an odd-number group containing at least one printing hammer arranged in an odd-number column and an even-number group containing at least one printing hammer arranged in an even-number column, the printing pins of said printing hammers in said even-number group being displaced by predetermined distances greater than zero in the direction of the printing line, and wherein at least one set of said N printing hammers are integrally formed to be a module structure such that said first end of each of said printing hammers is commonly connected;

wherein said module structure includes $N \times 2 \times M$ of said printing hammers, where M is an integer.

8. In a dot-line printer comprising a hammer bank carrying a plurality of dot printing hammers juxtaposed along a printing line, each of said plurality of dot printing hammers comprising a leaf spring having a first end fixedly secured to said hammer band and a second end to which a printing pin is attached, said hammer bank reciprocating with forward and backward movement along said printing line to thereby carry out printing of predetermined dot-lines as said hammer bank reciprocates and as a printing paper is fed over the predetermined dot-lines in a paper feeding direction perpendicular to said printing line, the improvement wherein said plurality of dot printing hammers are separated into a first group and a second group, the first and second groups containing first and second halves of said plurality of printing hammers, respectively, the first half of said printing hammers, in said first group, being fixedly secured to an upper part of said hammer bank so that second ends of said printing hammers in the first group extend downwardly along said paper feeding direction; and the second half of said printing hammers, in said second group, being fixedly secured to a lower part of said hammer bank so that second ends of said printing hammersd in the second group extend upwardly along said paper feeding direction, wherein said printing hammers in said first group and said printing hammers in said second group are alternately juxtaposed along the printing line and wherein adjacent printing pins of N dot printing hammers from the same group, N being an integer more than two, are displaced by one dot-line from one another in said paper feeding direction and said N dot printing hammers are respectively disposed along imaginary columns extending in said paper feeding direction, said printing hammers being divided into an odd-number group containing at least one printing hammer arranged in an odd-number column and an even-number group containing at least one printing hammer arranged in an even-number column, the printing pins of said printing hammers in said even-number group being displaced by predetermined distances greater than zero in the direction of the printing line, and wherein $N \times 2 \times M$ of said printing hammers are integrally formed to be a module structure where M is an integer such that said first end of each of said printing hammers is commonly and integrally connected to a connecting member, thereby 2N dot-lines can be printed simultaneously with each forward and backward movement of said hammer bank.

* * * * *